US005443187A

United States Patent [19]

Samuelson

[11] Patent Number: 5,443,187

[45] Date of Patent: Aug. 22, 1995

[54] PUMP APPARATUS FOR PUMPING MELT METAL

[75] Inventor: Sven-Erik Samuelson, Karlstad, Sweden

[73] Assignee: Metpump AB, Karlstad, Sweden

[21] Appl. No.: 284,416

[22] PCT Filed: Feb. 18, 1993

[86] PCT No.: PCT/SE93/00130

§ 371 Date: Aug. 2, 1994

§ 102(e) Date: Aug. 2, 1994

[87] PCT Pub. No.: WO93/16829

PCT Pub. Date: Sep. 2, 1993

[30] Foreign Application Priority Data

Feb. 20, 1992 [SE] Sweden ..... 9200512

[51] Int. Cl.[6] ..... B22D 39/06

[52] U.S. Cl. ..... 222/595; 266/89; 266/239

[58] Field of Search ..... 266/236, 239, 78, 89; 222/595

[56] References Cited

U.S. PATENT DOCUMENTS

| | | | |
|---|---|---|---|
| 2,185,376 | 1/1940 | McParlin | 222/595 |
| 3,058,432 | 10/1962 | Lamb | 266/239 |
| 3,448,898 | 6/1969 | Bennett | 222/595 |
| 3,652,073 | 3/1972 | Lewis | 266/239 |
| 3,800,986 | 4/1974 | Stamp | 266/239 |
| 4,010,876 | 3/1977 | Steinemann | 222/595 |
| 4,708,191 | 11/1987 | Block et al. | 164/150 |

FOREIGN PATENT DOCUMENTS

| | | |
|---|---|---|
| 040352 | 11/1981 | European Pat. Off. . |
| 190680 | 8/1986 | European Pat. Off. . |
| 1562046 | 2/1969 | France . |
| 2061708 | 6/1971 | France . |
| 1197591 | 7/1965 | Germany . |
| 2123287 | 6/1974 | Germany . |
| 2624435 | 3/1981 | Germany . |
| 3910689 | 9/1990 | Germany . |
| 3923079 | 1/1991 | Germany . |
| 1095856 | 4/1989 | Japan . |
| 646624 | 12/1984 | Switzerland . |
| 917298 | 1/1963 | United Kingdom . |
| 1596826 | 9/1981 | United Kingdom . |

*Primary Examiner*—Scott Kastler
*Attorney, Agent, or Firm*—Nixon & Vanderhye

[57] ABSTRACT

Molten metal is pumped from a furnace to a place where it is utilized using a gas-plunger pump having a container holding the chamber with an inlet for drawing metal from the furnace to the chamber, and with an outlet for forcing metal out of the chamber to the place of use. The inlet and outlet are disposed at the bottom of the chamber. A suction and pressure system includes a closed circuit containing a vacuum tank, a pressure tank, a vacuum pump/compressor unit connected between them, and a first valve. The closed circuit is connected to the chamber via a conduit. A control system alternately connects and disconnects the vacuum tank and pressure tank and substantially synchronously alternately opens and closes the inlet and outlet by actuation of valves associated with the inlet and outlet.

20 Claims, 6 Drawing Sheets

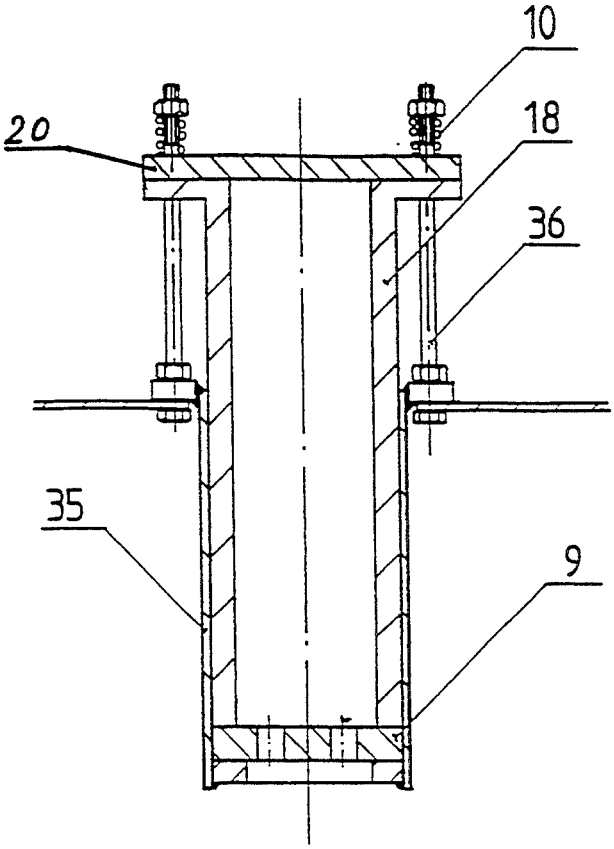
FIG. 6
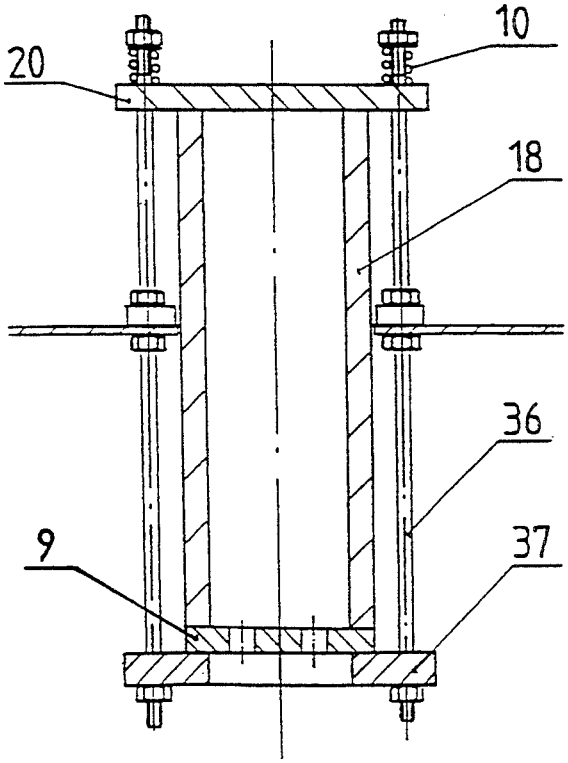

PUMP APPARATUS FOR PUMPING MELT METAL

BACKGROUND AND SUMMARY OF THE INVENTION

The present invention relates to a pump apparatus for pumping melt metal from a furnace to a place where it is to be used, said pump apparatus comprising a pump of gas-plunger type having a container holding a chamber with an inlet for drawing molten metal from the furnace to the chamber via a suction pipe immersed in the furnace melt, and with an outlet for forcing molten metal out of the chamber to the place of use; a gas-operated suction and pressure system comprising a suction source with a vacuum pump, a pressure source with a compressor and a conduit provided with valve means for alternately connecting and disconnecting the suction and pressure sources, the gas pressure of the latter acting directly on the melt in the chamber inside the container; and a control system for controlling the pump apparatus, said container being vertically aligned and arranged immediately above and in line with the furnace, said outlet being arranged at the bottom of the container.

It is known through patent specifications EP-190 680, U.S. Pat. No. 4,010,876, DE-1 197 591, GB-1 596 826, U.S. Pat. No. 4,708,191, FR-2 061 708, DE-3 923 079 and JP-1 095 856, for instance, to keep components that are in contact with the melt heated, to protect the melt with an inert gas, to measure the level of the melt inductively or capacitively, and to use graphite of ceramic material for certain components that are in contact with the melt.

Each of the known pump apparatus is limited to its own specific casting process and, if they are of the pressure-increasing type the mechanical designs are so complex that they reduce operating reliability and service life.

The object of the present invention is to achieve an improved pump apparatus that is relatively simple in design, reliable in operation, pressure-increasing, has long service life and can be used for all usual casting methods and metals.

The pump apparatus proposed according to the invention is substantially characterized in that the inlet of the container is arranged at the bottom thereof; that valve means are arranged inside the container to alternately open and close said inlet and outlet; that the suction and pressure system comprises a closed circuit containing a vacuum tank, a pressure tank, a vacuum pump/compressor unit connected therebetween, and said valve means, and is connected to the chamber in the container via said conduit; and that said control system is arranged to alternately connect and disconnect the vacuum tank and pressure tank and to synchronously or substantially synchronously therewith alternately open and close said inlet and outlet.

The pump apparatus according to the invention offers several valuable advantages over conventional pump apparatus:

- The entire pump is located above the melt. Only parts of the suction pipe and filter are located in the melt.
- The pump is pressure-increasing up to substantially the pressure provided by the vacuum pump/compressor unit. This improves the quality of the castings and increases productivity. Conventional systems for low-pressure casting produce approximately 1 bar.
- Thanks to a specific level-measuring system the level of the melt can be measured without any instrument coming into contact with the melt, and extremely accurate dosing is possible.
- A closed pipe system is used, thereby reducing oxidation of the molten metal.
- Simpler holding furnaces can be used.
- The working environment is improved since no open vessels containing melt need to be transported.

All parts of the pump apparatus according to the invention that come into contact with the melt are manufactured out of ceramic material, which is resistant to the melt (aluminium, for instance, is extremely aggressive to most materials) and withstands the temperature. All parts coming into contact with the melt are also surrounded by furnace modules and are thus heated. This prevents any "freezing" in pipes and pump. Like the factory furnaces, the pumps are heated during production stops and over weekends.

The pumping action is thus obtained by means of a gas-operated suction-pressure system. A vacuum pump/compressor unit is located between a vacuum tank and a pressure tank, this unit ensuring that the gas is evacuated in the vacuum tank and that a sufficiently high pressure prevails in the pressure tank. A valve effects the necessary switching between drawing up and forcing out the metal. Since the gas withdrawn from the pump is hot, it passes an accumulator where it emits energy. Similarly, the pressure-generating gas passes the accumulator and receives additional energy. This enables energy consumption to be as low as possible. The gas used is inert.

A system for lifting and possibly turning the pump valves is provided in order to regulate inflow and outflow of molten metal to the pump. Tests indicate that raising valves is to be preferred. The movement can of course be achieved using various types of drive sources.

The entire pump cycle is monitored by a control system, preferably a PLC. The advantage of the system is that flow and pressure are controlled throughout the cycle.

Thanks to the pump apparatus according to the invention being given the features described in claim 1 it can be used for all types of casting methods. It can therefore be connected to a place of use arranged, for instance, for casting melt in a mould, for dosing melt into a container in a die-casting machine, for dosing melt into a chill or sand form or for supplying melt through a die equipment of any desired profile.

BRIEF DESCRIPTION OF THE DRAWINGS

The invention will be described further in the following with reference to the drawings.

FIG. 6 shows longitudinal sections through two different embodiments of the suspension of the pump container.

DETAILED DESCRIPTION OF THE DRAWINGS

Figure 1:
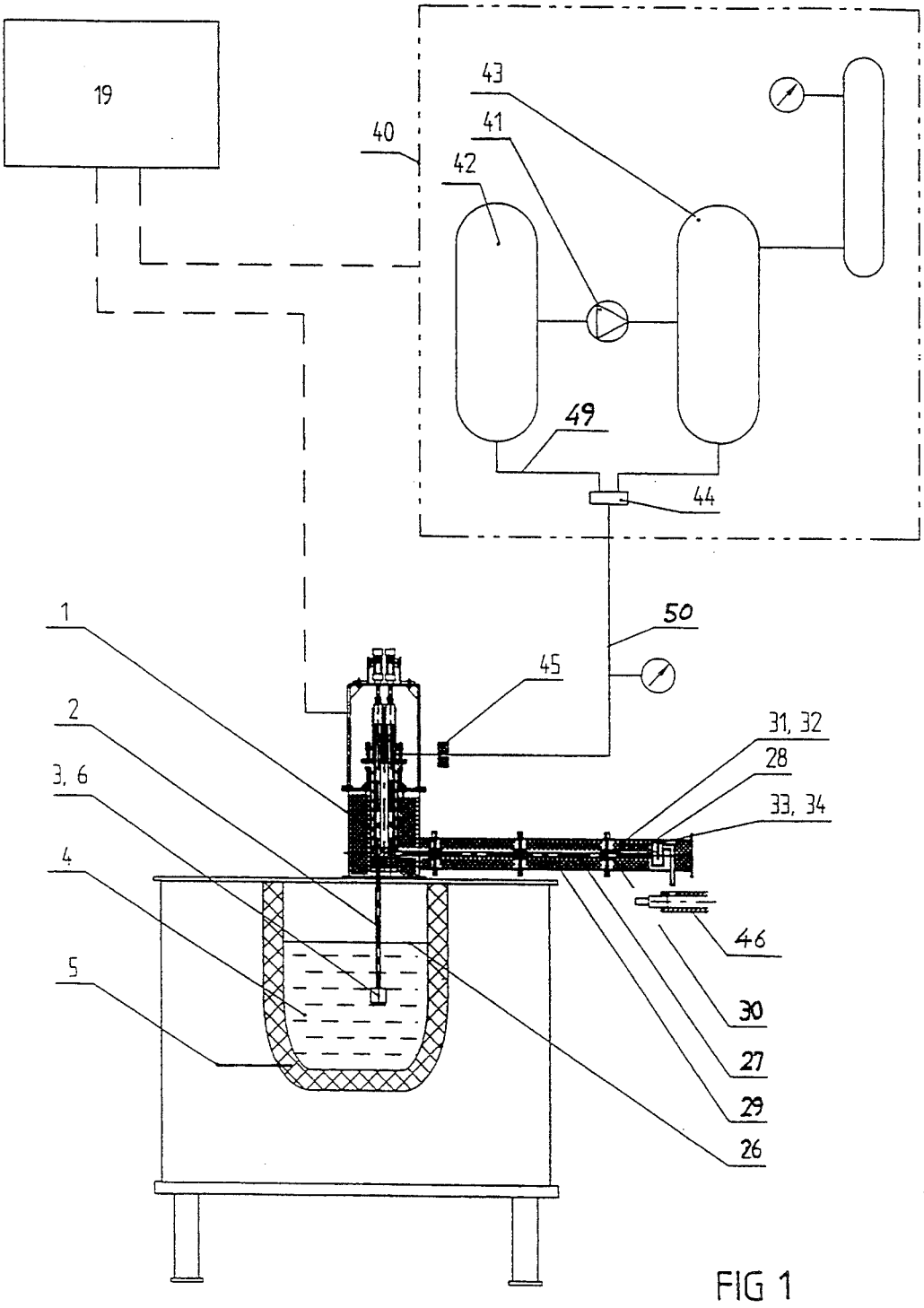
FIG. 1 is a side view of a furnace and a pump apparatus mounted thereon and having control system and gas-operated suction and pressure system.
Figure 2:
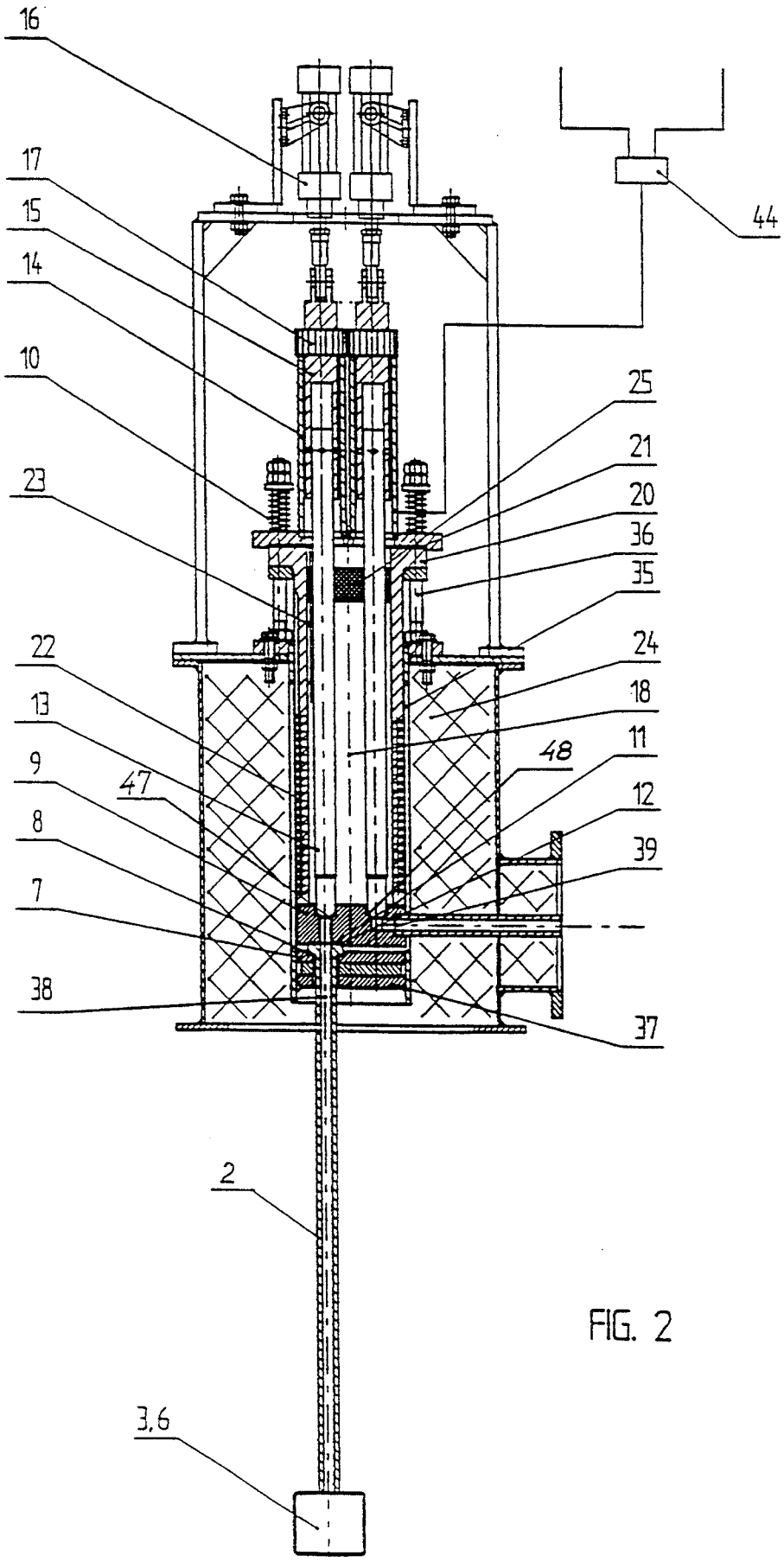
FIG. 2 is longitudinal section through the pump apparatus according to FIG. 1 but with said two systems omitted.

With reference to FIGS. 1 and 2 it is shown schematically therein a pump apparatus for liquid metal, comprising a pump 1 having a container with a chamber 18 to receive melt 4. The width or diameter of the chamber 18 is small in relation to its height, e.g. about 1:14–1:7, preferably 1:5. A ceramic filter 3 is mounted at the inlet to the suction pipe 2 of the pump 1, in order to remove any impurities in the melt 4, the melt being enclosed in gas-tight condition in a furnace 5. This filter 3 must be replaced at regular intervals. When replacing the filter the entire pump 1 is lifted up out of the furnace 5 and the replacement is facilitated since the filter holder 6 is kept in place by a quick connection.

The suction pipe 2 is made of ceramic material. An edge on the suction pipe allows it to be pressed against a support plate 7, see FIG. 3. Dampening insulation 8 is placed between the pipe 2 and plate 7 to prevent chipping of the edge. The joint between the suction pipe 2 and a block 9 must be gas-tight. This can be achieved by both contact surfaces being lapped to provide sufficient adhesion for the sealing function, compare gauge block system, or by using seals. Extra abutment is also effected using a spring system 10. A graphite seal 11 is used since conventional seals are not resistant to aluminium. However, graphite becomes oxidized at high temperatures and a compressible seal 12 is therefore placed outside the graphite seal 11 to prevent oxidation. The graphite seal 11 seals against the melt and the outer, conventional seal 12 protects the graphite seal 11 from oxygen in the air.

The block 9 is made of ceramic material with valve seats for the rod-shaped valve cones 13. The valve seat is preferably conical to avoid chipping of the ceramic and to better fit the spherical form of the valve cones 13, see FIG. 3. Since the valve cones 13 also come into contact with the melt, these are made of ceramic material. The cones 13 are guided by graphite bushing 14 and are attached in metallic holders 15 which are in turn secured to the lifting and turning devices 16 and 17, respectively. The lower ends of the cones 13 are spherical to compensate unintentional inclination.

Figure 3:
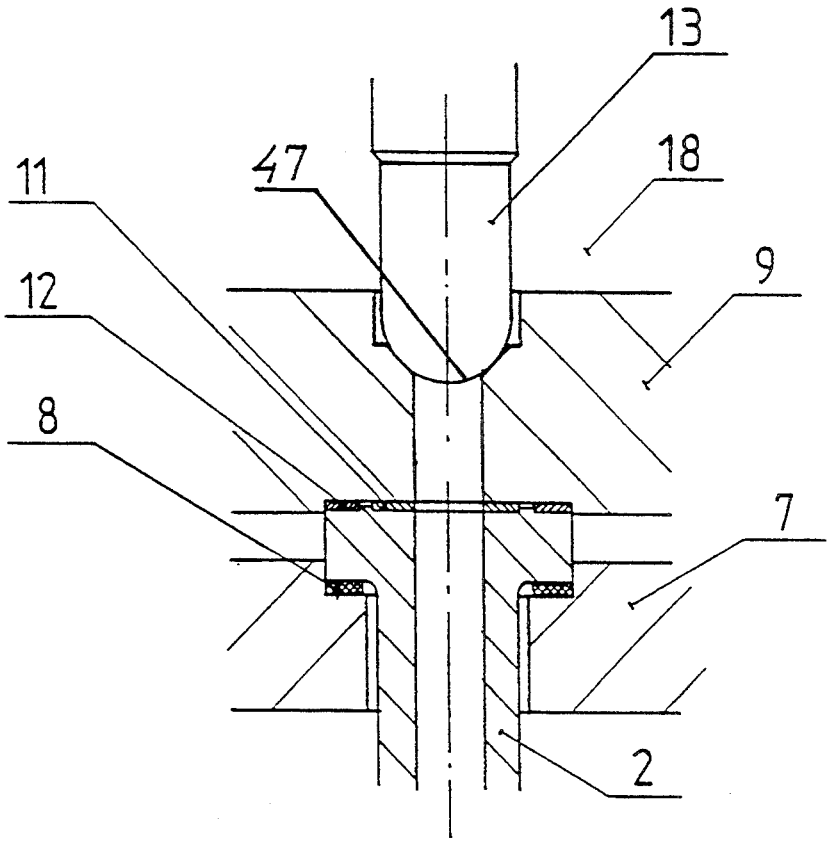
FIG. 3 shows cross-sectional views of the bottom part of the pump in the pump apparatus shown in FIG. 2 and show a valve cone and its co-operation with the valve seat in the bottom plate, and connection of the suction pipe.
Figure 3:
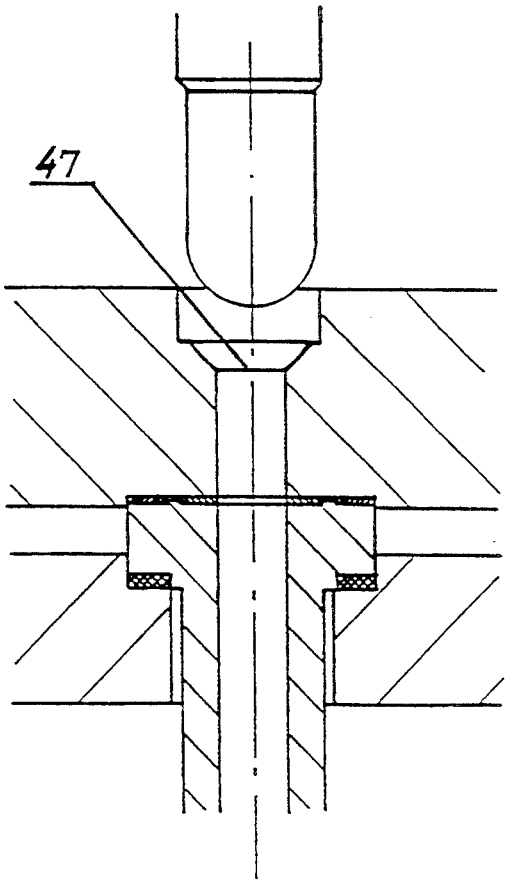

It has been found that impurities in the melt adhere more easily to the pump components at high flow rates, and the cones 13 therefore open a gap between themselves and the block 9 before evacuation or build-up of pressure has occurred in the chamber 18 in the container, see FIG. 3. The control system 19 then balances the fluid pressure and gas pressure so that no flow occurs. Evacuation or pressure build-up in the chamber 18 in the container occurs when the gap is at its largest.

Since impurities may adhere to the material in the block 9 and cones 13 despite the measures described above, the cones 13 are turned at regular intervals so that they are ground against the valve seat in the block 9. Turning is achieved by means of turning devices 17.

The container holding the chamber 18 is also made of ceramic material and hold the melt to be dosed out to the user. It must therefore be gas-tight to both the block 9 and an upper container flange 20. The seal against the block 9 is in principle the same as the one described earlier for the suction pipe 2. A conventional seal 21 may be used for the container flange 20 since this does not come into contact with the melt.

A helical groove is provided in the lower part of the container which encloses the chamber 18. A metal wire 22 is placed in this groove so that a solenoid is achieved. By allowing a high-frequency current to pass through the solenoid, a specific inductance is obtained. When the metal flows into the chamber 18 inside the container, the inductance alters depending on the level of the metal. The level can be established by feeding these signals into the control system 19 included in the pump apparatus. The starting position is always the maximum level. To prevent overfilling the chamber 18 in the container an electrode 23 acting as a safety breaker, is installed in the container. With the aid of other signals to and from the place of use and the pump 1, the system 19 is able to control the casting process with respect to both the flow and pressure.

The container holding the chamber 18 is surrounded by a furnace 24 which provides the desired temperature.

In order to avoid radiation heat on the container flange 20, an insulation 25 is placed between the melt surface 26 and the container flange 20. The insulation is suspended on shoulders (not shown) in the chamber 18 and permits the passage of gas in both directions.

Figure 4:
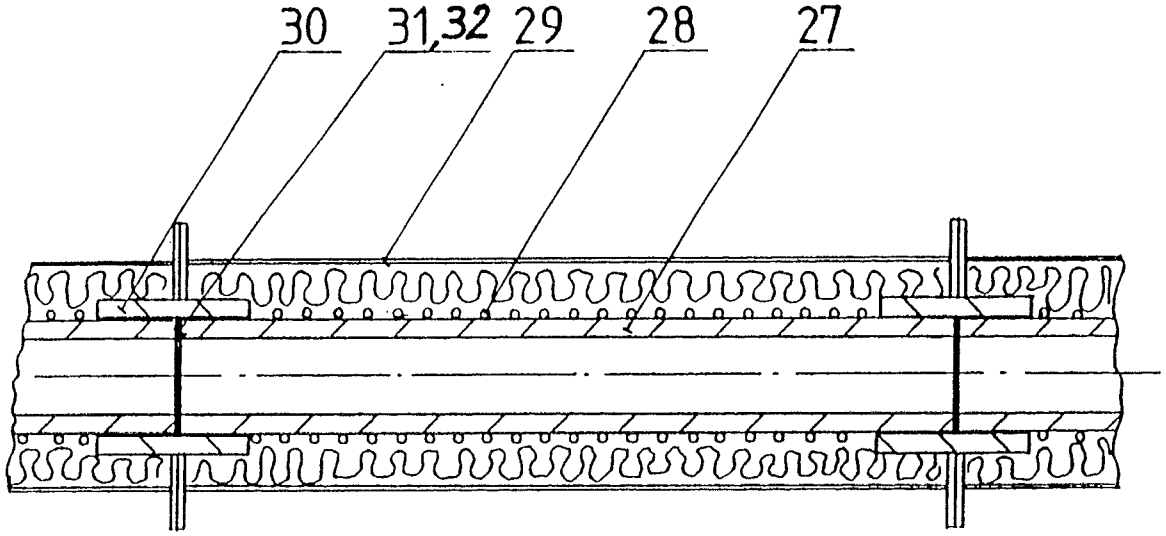
FIG. 4 is a longitudinal section through a part of the pipe connection between pump and place of use.

The outlet pipe has parts 27 surrounded by furnace modules 28, see FIG. 4. The parts 27 of the outlet pipe and the furnace modules 28 are supported by outer metal pipes 29 acting as supporting elements up to the place of use. Seals 31 are mounted between the parts 27 of the outlet pipe and the parts 27 are joined with the aid of jointing sleeves 30. Since pressure build-up will occur in the outlet pipe 27, the sealing is substantially the same as that described previously for the suction pipe 2. That being so, a graphite seal 32 is added.

Figure 5:
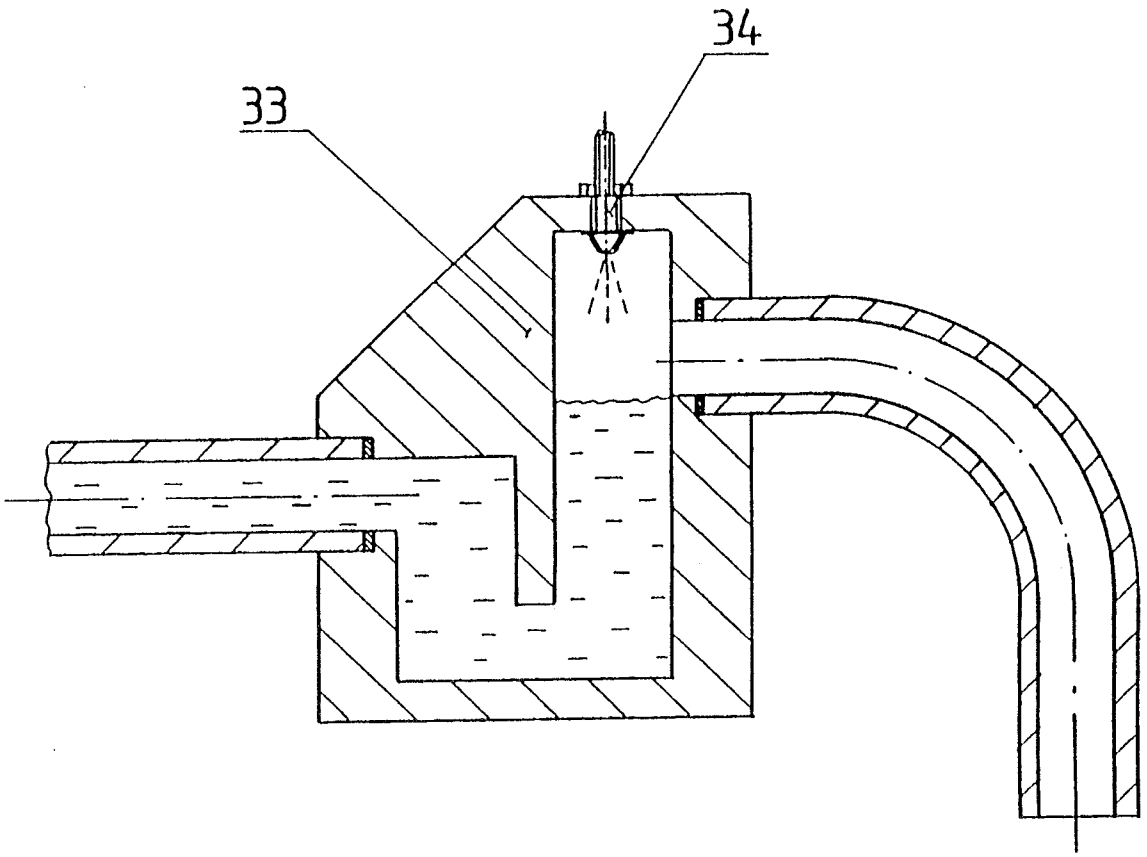
FIG. 5 is a longitudinal section through an interceptor at the outer end of the connection from the pump.

An interceptor 33 is mounted at the end of the outlet pipe 27, see FIG. 5. The interceptor 33 acts to automatically maintain the melt level and also as a protective seal against oxygen. As additional protection against the formation of metal oxides, an automatic spray device 34 for oxide-solving chemicals may be installed above the interceptor 33.

Either a suspended pipe 35 or a bottom flange 37 in combination with connecting rods 36 is used to keep the various parts of the pump together, see FIG. 6. Clamping is obtained by tensioning the container holding the chamber 18 and block 9, between the container flange 20 and suspended pipe 35 (FIG. 6, upper picture) or the bottom flange 37 (FIG. 6, lower picture). To eliminate problems with the different coefficients of linear expansion in the various materials, the package is clamped with the aid of said spring system 10.

The pump 1 can be designated a gas-plunger pump operating with an inert gas as plunger. At evacuation of the container volume, the valve cone 13 opens at the inlet 38 and the melt rises in the chamber 18 inside the container. When molten metal is required at the place of use, the valve cone 13 opens at the outlet 39 and gas forces the melt out until the predetermined volume has been obtained.

The pump apparatus also includes a suction and pressure system 40 comprising a closed circuit 49 including a vacuum pump/compressor unit 41, a vacuum tank 42, a pressure tank 43 and a valve 44, the circuit 40 being connected via said valve 44 to the chamber 18 in the container by a conduit 50 containing a heat accumulator 45. The system 40 is thus entirely closed and no gas is therefore consumed. The vacuum pump/compressor unit 41 operates continuously, transporting gas from the vacuum tank 42 to the pressure tank 43. Upon evacuation, the valve 44 opens the communication between the chamber 18 in the container and the vacuum tank 42. When the melt is forced out, the valve 44 opens the communication between the chamber 18 and the pressure tank 43. To ensure minimum energy loss, the gas emits thermal energy to the heat accumulator 45 at evacuation and extracts energy from this accumulator 45 when pressing out melt.

The whole casting and dosing process is monitored by the control system 19 in such a way that flow and pressure are regulated and controlled throughout the casting process.

I claim:

1. A pump apparatus for pumping molten metal from a furnace to a place where it is to be used, comprising: a gas-plunger pump having a container holding a chamber with an inlet for drawing molten metal from the furnace to the chamber via a suction pipe immersed in the furnace melt, and with an outlet for forcing molten metal out of the chamber to the place of use; a gas-operated suction and pressure system comprising a suction source with a vacuum pump, a pressure source with a compressor and a conduit providing with first valve means for alternately connecting and disconnecting the suction and pressure sources, the gas pressure of the latter acting directly on the melt in the chamber inside the container; a control system for controlling the pump apparatus; said container being vertically aligned and disposed immediately above and in line with the furnace, said outlet being disposed at the bottom of the container; said inlet of said container is disposed at the bottom of said container; wherein said suction and pressure system comprises a closed circuit containing a vacuum tank, a pressure tank, a vacuum pump/compressor unit connected therebetween, and said first valve means, and is connected to the chamber in the container via said conduit; and wherein that said control system is disposed to alternately connect and disconnect the vacuum tank and pressure tank and to substantially synchronously therewith alternately open and close said inlet and outlet.

2. A pump apparatus as claimed in claim 1, wherein a heat accumulator 45 is arranged in the conduit 50 connecting said circuit 49 to the chamber 18 in the container, in order to store thermal energy from the gas flowing out of the chamber 18 and emit thermal energy to the gas flowing into the chamber 18.

3. A pump apparatus as claimed in claim 1, wherein the valve means inside the chamber 18 in the container consist of vertical valve cones 13 of ceramic material, each connected to a lifting device mounted outside the pump 1 for raising and lowering the valve cone 13 in relation to the valve seat of the inlet 47 and outlet 48, respectively, and that the valve cones 13 and valve seats have cooperating spherical and/or conical sealing surfaces.

4. A pump apparatus as claimed in claim 3, wherein the valve cones 13 are pivotably journalled by means of a turning device 17 to effect grinding of the sealing surfaces in order to remove impurities that adhere thereon from the melt.

5. A pump apparatus as claimed in any of claim 1, wherein the control system 19 is arranged to control the valve means 44 in the circuit 49 and the valve means 13 within the chamber 18 so that, before a suction or pressure phase is commenced, the pressure is balanced and the relevant valve means 13 is partially opened in order to minimize the flow rate of the melt into or out of the chamber 18.

6. A pump apparatus as claimed in any of claim 1, wherein a metal wire 22 is mounted in or on the outer side of the wall of the container holding the chamber 18, in order to form a solenoid in a current circuit, the inductance of the solenoid constituting a value indicating the level of the melt in the chamber 18.

7. A pump apparatus as claimed in any of claim 1, wherein the facing sealing surfaces of every joint between two components of the pump apparatus that come into contact with melt are sealed both by a conventional external seal 31 which will withstand high temperatures, as a protection against oxygen, and also a graphite seal 32 as a protection against the melt.

8. A pump apparatus as claimed in any of claim 1, wherein an interceptor 33 is arranged at the end of the connection 27 between the container holding the chamber 18 and the place of use.

9. A pump apparatus as claimed in claim 8, wherein a spray device 34 is arranged in conjunction with the interceptor 33 for the supply of chemicals to dissolve oxides.

10. A pump apparatus as claimed in any of claim 1, wherein a ceramic filter 3 is arranged in the end of the suction pipe 2 immersed in the melt and is arranged to be replaced by raising the pump 1 together with the suction pipe.

11. A pump apparatus as claimed in any of claim 1, wherein an insulating body 25 is arranged in the upper part of the container holding the chamber 18 closed by a container flange 21, said insulating body 25 forming a protection against radiation from the melt located below the insulating body 25.

12. A pump apparatus as claimed in any of claim 1, wherein the container holding the chamber 18, and the block-shaped bottom 9 of the container are spring-clamped between an upper container flange 20 and either a suspended pipe 35 or a bottom flange 37 in combination with connecting rods 36 spring-clamped by means of spring devices 10 at the container flange 20.

13. A pump apparatus as claimed in any of claim 1, wherein the control system 19 is arranged at regular intervals to open the valve means 13 in the inlet 47 from the suction pipe 2 and simultaneously connect the pressure tank 43 in order for the gas to force the melt back through the suction pipe 2 and through a filter 3 arranged at its lower end, thereby cleansing it from particles.

14. A pump of a gas-plunger type for pumping molten metal, comprising:

a chamber having an inlet, a suction pipe connected to the inlet, and an outlet, said outlet being provided adjacent the bottom of said chamber and said inlet also being disposed adjacent the bottom of said chamber;

a gas operated suction and pressure system having suction and pressure sources, and comprising: a conduit with a first valve for alternately connecting and disconnecting the suction and pressure sources, said conduit connected to said chamber; a vacuum tank; a pressure tank; and a vacuum pump/compressor connected between said vacuum tank and said pressure tank;

a second valve disposed inside said chamber to alternately open and close said inlet and outlet; and control means for alternately connecting and disconnecting said vacuum tank and pressure tank and to substantially synchronously therewith alternately open and close said second valve to open and close said inlet and outlet.

15. Apparatus as recited in claim 14 wherein said control means comprises means for controlling said first and second valves so that before a suction or pressure phase is commenced the pressure is balanced and said second valve is partially opened in order to minimize the flow rate of molten metal into or out of said chamber.

16. Apparatus as recited in claim 14 further comprising a heat accumulator disposed in said conduit for storing thermal energy from gas flowing out of said chamber, and for supplying thermal energy to gas flowing into said chamber.

17. Apparatus as recited in claim 14 wherein said second valve comprises a plurality of vertically disposed valve cones of ceramic material each connected to a lifting device disposed outside of said pump for raising and lowering said valve cone with respect to a valve seat defining said inlet or outlet, respectively, said valve cones and valve seats having cooperating spherical or conical sealing surfaces.

18. Apparatus as recited in claim 14 further comprising an interceptor connected to said chamber, and a spray device for supplying chemicals, to dissolve oxides, to said interceptor.

19. Apparatus as recited in claim 14 wherein said control means further comprise means for opening said second valve at said inlet and simultaneously connecting said pressure tank to said chamber so that gas from said pressure tank forces molten metal out of said suction pipe; and further comprising a filter disposed at an end of said suction pipe remote from said chamber, said control means forcing molten metal through said filter to clean particles therefrom.

20. Apparatus as recited in claim 14 further comprising a block shaped bottom portion defining said chamber and operatively spring clamped to an upper flange also defining said chamber.

* * * * *